United States Patent [19]

von der Eltz et al.

[11] 4,082,502

[45] Apr. 4, 1978

[54] PROCESS FOR THE DYEING OF SYNTHETIC OR NATURAL FIBERS

[75] Inventors: Hans-Ulrich von der Eltz, Frankfurt am Main; Albert Reuther, Schwalbach, Taunus; Hans-Joachim Wassmuth, Hattersheim, all of Germany

[73] Assignee: Hoechst Aktiengesellschaft, Frankfurt am Main, Germany

[21] Appl. No.: 718,098

[22] Filed: Aug. 26, 1976

Related U.S. Application Data

[63] Continuation-in-part of Ser. No. 553,557, Feb. 27, 1975, abandoned, Ser. No. 442,819, Feb. 15, 1974, abandoned, Ser. No. 442,818, Feb. 15, 1974, abandoned, Ser. No. 442,813, Feb. 15, 1974, abandoned, and Ser. No. 396,515, Sep. 12, 1973, abandoned.

[30] Foreign Application Priority Data

| | | |
|---|---|---|
| Jun. 22, 1973 | Germany | 2331669 |
| Nov. 17, 1973 | Germany | 2357476 |
| Nov. 17, 1973 | Germany | 2357447 |
| Nov. 17, 1973 | Germany | 2357439 |
| Mar. 1, 1974 | Germany | 2409727 |

[51] Int. Cl.[2] ..... D06P 1/00; D06B 9/02; D06B 15/00

[52] U.S. Cl. ..... 8/34; 8/32; 8/37; 8/149.1; 8/149.3; 8/154; 8/158; 8/176; 8/DIG. 16

[58] Field of Search ..... 8/176, 32, DIG. 16, 8/154, 149.3, 34, 37, 158, 149.1

[56] References Cited

U.S. PATENT DOCUMENTS

| | | | |
|---|---|---|---|
| 1,800,639 | 4/1931 | Jefferson | 8/DIG. 15 |
| 1,948,568 | 2/1934 | Faber | 8/19 |
| 3,771,954 | 11/1973 | Karrer et al. | 8/149.1 |
| 3,775,055 | 11/1973 | Wedler | 8/155.1 |

*Primary Examiner*—John Kight, III
*Attorney, Agent, or Firm*—Curtis, Morris & Safford

[57] ABSTRACT

Process for the exhaust dyeing of wound bodies of synthetic or natural fiber materials with appropriate dyestuffs, by heating the wound-up textile articles to temperatures ranging at or above 100° C while replacing the air in the dyeing vessel by saturated or superheated steam, and by preparing the dye bath in the batch vessel which is connected by pipes with the dyeing vessel, and heating up the dyebath to temperatures also ranging at or above 100° C. A special control of the temperature and of the steam pressure in both closed systems is provided to secure the formation of a relative excess pressure of 2.94 to 9.8 bars in the batch vessel or such an excess pressure is produced from the outside. The hot dyebath is pressed by the differential pressure over a period of 3 to 60 seconds at the same time from inside and outside into the dry or wet wound bodies.

14 Claims, No Drawings

PROCESS FOR THE DYEING OF SYNTHETIC OR NATURAL FIBERS

This application is a consolidated continuation-in-part of U.S. Pat. applications Ser. Nos. 553,557, filed Feb. 27, 1975; 442,818, filed Feb. 15, 1974; 442,819 filed Feb. 15, 1974; 442,813, filed Feb. 15, 1974; and of 396,515, filed Sept. 12, 1973. All of the above applications are now abandoned.

The present invention relates to a process for the dyeing of synthetic and natural fibers.

Exhaust processes for the dyeing of synthetic and natural fibers under high temperature (HT) conditions or at boiling temperature on corresponding pressure-tight apparatuses, such as HT-jet-dyeing apparatus, HT-jiggers, HT-winch becks, HT-beam dyeing apparatus, equipments which are operated according to the overflow principle or similar apparatus, are well known. Depending on the apparatus, on the kind of the fiber and on the dyestuff class, dyeing times of 60 to 180 minutes are generally required in order to control the absorption of the dyestuffs in such a manner that level dyeings are obtained. Under the thermal conditions of these processes, the affinity of the dyestuffs is strongly increased so that long dyeing times are required for levelling.

The present invention provides a process for the dyeing of textile materials in the form of wound bodies according to the exhaust method at temperatures ranging at or above 100° C, in which process the wound bodies contained in a pressure-tight dyeing vessel are heated as well as deaerated before the actual dyeing operation and subsequently contacted with the dyeing liquor which has been separately heated to about dyeing temperature in a pressure tight batch vessel, placed under a relative excess pressure of from 2.94 to 9.81 bars and then transferred in its total amount from said batch vessel into said dyeing vessel, and in which the dyeing operation is completed by circulation of the dyeing liquor.

A process of such a type is described in German Offenlegungsschriften Nos. 1,785,278 and 2,203,401. Corresponding to this prior art deaeration by means of vacuum is the characteristic feature. This proceeding is done with the intent in order to enable the transfer of the hot treating liquor from the batch vessel into the dyeing vessel as unresistingly and rapidly as possible. Since in technical equipments of industrial scale there may be generated only partial vacuum conditions using a vacuum pump, it still remains a residual pressure which is offering a certain resistance towards the entering liquor. Moreover, the vacuum conditions compulsorily lead to a strong cooling of the total system due to the expansion of the air or volatilation of the moisture, whether from the textile material or the adhering liquor. This is also the case when the whole dyeing system (apparatus and textile material) has been preheated, for example by steaming, prior to the evacuating procedure. Every time, there is originated a considerable difference in the temperatures between the textile goods and the dyeing liquor resulting in strong unlevelness of the dyeings so produced when rapidly contacting one with another.

The present invention is concerned with the problem to improve the above-indicated high temperature exhaust dyeing process in such an extent that particularly level dyeings on the fibrous materials to be dyed can be obtained, even with combinations of several dyestuffs which normally are difficult to dye, with at the same time an essentially shorter dyeing time.

This problem is solved according to the present invention in that the wound bodies are exposed to an atmosphere of steam at about dyeing temperature prior to contact with the dyeing liquor in order to preheat and de-aerate said textile materials; and the dyeing liquor is transferred by means of said relative excess pressure and towards the pressure of the air-free atmosphere of the steam into the dyeing vessel, simultaneously from both the inside and the outside of said wound bodies, thereby entirely condensing the steam in said vessel and filling it completely by the transferred liquor.

The principle of the present invention consists in that a dyebath is prepared in a HT-vessel under the selected pressure and temperature conditions and is passed from there by means of pressure (pressurized steam, compressed air, pump pressure) into another autoclave filled with steam and containing the wound bodies of synthetic or natural fibers, for example wound-up filaments or balls of piece goods wound up on dyeing beams. This is effected by pressing the bath simultaneously from the outside and from the inside into the wound bodies through correspondingly sized tubes, pumps and distributor valve. This permits uniform distribution of the dyeing liquor in the goods to be dyed within an extremely short time, even with strongly crimped or with texturized synthetic fibers, without any deformation of the wound bodies and filaments. In general, periods of 3 to 60 seconds, in most cases even less than 30 seconds, are required for this purpose. This rapid "shooting-in" of the dyebath is achieved by a high pressure from the side of the batch vessel which contains the dyebath (pressure difference from about 3 to 10 bars). The vessel in which the dyeing operation takes place is previously deaerated by pressurized steam and at the same time the goods are preheated. The textile material may be dry or prewashed, which process can be carried out in the dyeing vessel itself.

The dyeing vessel is pressure-tight, well isolated and provided with a heat exchanger of high capacity in order to hold the dyeing temperature constant.

The bath is heated in the batch vessel to dyeing temperatures ranging at or above 100° C and then pressed into the dyeing vessel which is filled with steam. During the transfer of dyeing liquor, the dyeing vessel is filled completely (fully flooded) even when the dyeing vessels and batch vessels are connected together as a closed system, provided that a sufficient differential pressure is initially achieved, because the steam in the dyeing vessel condenses as the liquor is transferred and the pressure in the dyeing vessel increases.

When the total dyeing liquor is in the dyeing vessel, i.e. when "shooting-in" is completed, the liquor is pumped with the aid of a circulation pump alternately from inside to the outside and from the outside to the inside through the wound material, whereby the circulation pump may start during the filling phase. The selected dyeing temperature is maintained during this time. Then, final fixation of the dyestuff takes place within a short time. As the absorption speeds are generally high under these temperature conditions, it is of advantage to operate with sufficiently high output of the pump. An output of 40 – 60 l/kg.min gives a good dyeing result. In the case of dyestuffs or dyestuff combinations which are more difficult to dye level, the output must be higher than 60 l/kg.min.

Due to the fact that the total dyeing liquor is introduced with high speed into the dyeing vessel and onto and into the more or less dry material in the form of wound bodies, the present process differs from the hitherto applied normal and high temperature dyeing processes which, including all their variants, have extensively been discussed in literature. Thus, according to the invention, not just a part of the dyestuff solution or dispersion is introduced into the dyeing vessel, but the total amount of the dyeing liquor is pressed into it almost suddenly. It was not foreseeable that under these conditions level dyeings can be obtained, since most of the dyestuffs have an extremely high absorptive power at these temperatures.

Furthermore, it could not be expected that the dyestuff dispersions would be still suitable at such high temperatures, pressure differences and possible turbulences for the penetration into the wound bodies. It has been surprising that the dyestuff dispersions, even in the case of combinations of several disperse dyestuffs, remain stable under these difficult conditions with regard to apparatus and do not tend to form agglomerations.

An essential advantage in the process of the invention resides in the fact that the absorptive power of the dyestuff can be fully utilized at the high temperatures used.

The good levelness of the dyeing is obtained by the fact that it is possible according to the process of the invention to shoot in the bath extremely rapidly whereby it is brought immediately and at any place into contact with the goods and then to continue dyeing directly with a high circulation of the bath. Levelness of the dyeing is assisted by ensuring that the circulation of the bath is not interrupted when switching over, which, as is known, may be achieved by a four-way connection or valve control.

Normally, the process described above is carried out in an aqueous medium; however, it may also be applied in the dyeing from organic solvents. In the latter case, the boiling point which is typical for the respective solvent and the vapor pressure must, of course, be taken into consideration for the reaction conditions.

In the process of the invention, there may be used any types of fibers of synthetic origin in any stage of processing, which can be dyed according to the HT dyeing method. Textile materials made from synthetic fibers, for example polyamide and preferably linear polyester fibers, or from mixtures which contain such synthetic fibers are dyed with water-insoluble disperse dyes at temperatures in the range of from 100° to 145° C. Suitable disperse dyes for this purpose are known from Colour Index, 3rd Edition (1971), Volume 2. In the dyeing of polyester fibers, dispersing and levelling agents and chemical substances for the adjustement of the pH-value are generally used. Reproducibility of the dyeing with disperse dyestuffs may be achieved by maintaining the pH of the bath at from 4.5 to 5.5, for example by means of known suitable buffer systems.

Synthetic fibers, preferably texturized threads of polyesters and threads or fibers of triacetate, or mixtures which contain such synthetic fibers, can also be dyed according to the novel process with primary components that are used for the preparation of water-insoluble developing black dyestuffs at temperatures in the range of from 105° to 135° C, and said dyestuffs can be developed by methods based on the diazo and oxidation dyeing technique under the above-mentioned pressure and temperature conditions using a second liquor. The primary components of such developing black dyestuffs are described under the class designation "Azoic Dyes" in Colour Index 3rd Edition (1971), Volume 1. The dyebaths so employed contain dispersing agents and the chemical products for adjusting the pH-value and to diazotize or purify the fiber material. For reproducibility of the dyeings pH-value 6 if favorable which is achieved by means of known suitable buffer systems.

Moreover, the process of the present invention may be applied to such synthetic fibers that are dyeable under HT-dyeing conditions with ionic dyestuffs, or to mixtures containing synthetic fibers of said type. There are meant on the one hand polyamide, polyurethane, basic modified polyester or polyolefin fibers which can be dyed with water-soluble anionic dyestuffs such as acid, calcium, metal complex and reactive dyestuffs. On the other hand, there may also be used polyacrylonitrile or acid modified polyester or polyolefin fibers which can be dyed with water-soluble cationic dyestuffs. Such dyestuffs are described in Colour Index, 3rd Edition, (1971), Volume 1 or 3 under the class designation "Basic Dyes," "Acid Dyes" or "Reactive Dyes." Dyeing of these synthetic fibers with ionic dyestuffs as mentioned above is carried out at temperatures in the range of from 100° to 120° C (when dyeing polyacrylonitrile and polyurethane fibers not higher than 110° C). When dyeing polyacrylonitrile fibers and polyamide fibers, no other additions are necessary except levelling agents and the substances required for adjusting the pH-value. The constancy of the pH-value of the dyebath between pH 4.5 and 5.5 permits reproducibility of the dyeings and is attained by known suitable buffer systems.

As regards the dyeing of synthetic fibers, the new process is preferably applied to texturized fibers of linear polyester, polyamide, polyacryl and modified polyester material, since such fibers tend particularly to unlevel dyeings of their thermal pretreatment during texturization.

For carrying out the claimed process, wool and its mixtures with synthetic fibers or cellulose fibers in any processing stage are suitable which can be dyed according to HT-dyeing methods or at boiling temperature. For this purpose, anionic dyestuffs such as acid, chromium, metal complex and reactive dyestuffs are used at dyeing temperatures in the range of from 100° to 110° C. Dyestuffs of said category are listed under the class designation "Acid Dyes" and "Reactive Dyes" in Colour Index, 3rd Edition (1971), Volume 1 or 3. In the dyeing of woll fibers, the dyeing liquors do not contain further additions other than leveling agents and pH-regulating substances. A pH-value ranging between 2 and 8.5 is adjusted and maintained with the aid of known suitable buffer systems.

When dyeing cellulose fibers and their mixtures with polyester or with other synthetic fibers such as polyacrylonitrile, polyamide or modified polyester fibers according to the process of this invention, appropriate soluble dyestuffs or solubilized vat or sulfur dyestuffs are applied at temperatures in the range of from 100° to 135° C. Suitable dyestuffs may be vat dyestuffs, sulfur vat dyestuffs, sulfur dyestuffs, soluble sulfur dyestuffs, leuco-vat ester dyestuffs, reactive dyestuffs and direct dyestuffs which are classified in Colour Index, 3rd Edition (1971) under the generic names "Vat Dyes", "Solubilised Sulphur Dyes," "Solublised Vat Dyes," "Reactive Dyes" and "Direct Dyes." In the dyeing of cellulose fibers with the above-identified dyestuffs no other additions are necessary except levelling agents and the substances for required for adjusting the pH value.

As the technical problems concerns in connection with the feeding operation of the apparatus according to the claimed process, i.e. in order to provide that the dyeing vessel is filled with the liquor simultaneously from both the inside and the outside of the wound body, a series of suitable solutions are available. There, for example, use is made of an Y-shaped branched piping, one branch thereof is entering into the dyeing vessel via the perforated support at the inside of the wound body, whereas the other branch enters into the dyeing vessel from the outside in respect to the wound body, each branch as well as the feeding pipe are capable of being shut off by means of a valve. In order to attain a rapid liquor transfer pipes and valves have to be sized corresponding to the desired capacity, and the circulation pump must be powerful. Transfer of the liquor is carried out while the valves of both branch pipes are opened and the circulation pump is running so that the circulation can be started immediately after the filling phase of the dyeing vessel is completed.

In comparison to the prior art described by German Offenlegungsschriften Nos. 1,785,278 and 2,203,401, the decisive difference of the principle of the present invention resides in the fact that the treating vessel is filled with highly pressurized steam (of about the same temperature as the following dyeing process), rather than evacuated, until the temperature thereof is compensated. Thus, the dyeing vessel always contains a steam atmosphere. During the rapid transfer of the dyeing liquor which is exposed to high pressure, from the batch vessel into the dyeing vessel, all of the steam atmosphere being present in the latter is collapsed under condensation as a consequence of the applied differential pressure and whereby, moreover, the heat of condensation is freed in the course of that proceeding. By this way, no drop of temperature occurs in the present case, which would give trouble as described above.

In addition to the presteaming operation of the fibrous material in order to heat the wound bodies up to dyeing temperature, it has according to the claimed process proved to be essential, on the one hand for the uniformity of the dyeing and on the other hand to avoid tendering of the fiber package, to shoot in the dyeing liquor into the textile goods simultaneously from both the inside and the outside of the wound-up material. Only in this manner an isothermal rapid dyeing method of wound bodies consisting of synthetic fibers while resulting level shades is possible.

In contradistinction to this invention, the flow direction of the liquor fed in into the material package is pre-determined in the known dyeing process from the inside to the outside by the applied vacuum and takes place unilateral in dependence on the density conditions of the winding differently, accompanied by a likewise differently cooling-off of the liquor and by a corresponding impoverishment of the dyestuff in the dyeing liquor. The result is an unlevelness of the dyeings which can be removed only with difficulties as far as light nuances are concerned. According to experience it is practically impossible to produce very light shades when using the vacuum method. As a further demonstrable disadvantage of the vacuum technique is considered the uncontrollable deformation of the wound bodies and, above all, the strain of the highly sensitive, texturized fiber materials.

The foregoing disclosed disadvantages of the vacuum technique are avoided by the process of the present invention. By the presteaming operation the fibrous material is not only deaerated but it is, above all, heated up to dyeing temperature, the goods inclusive of the apparatus. By this way, any differences of temperature are eliminated in the present case which set in upon introducing of the hot dyeing liquid according to the vacuum technique and which promptly affect to heavy differences of affinity when temperatures above 100° C are applied. The dyeing liquor which is introduced into the dyeing vessel according to the claimed process finds everywhere the same temperature conditions and is itself not locally cooled down.

To the fortuitous results which appear in the course of the liquor introduction using the vacuum method, there is deliberately opposed according to this invention the liquor transfer at the same time both from the inside and the outside of the material package, to which must be added that the circulation pump is put into motion still during the introduction of the liquor into the wound body. Thus, the goods are exposed only to the differential pressure of the fed-in liquor and not additionally to the high pressure difference between the batch vessel and the vacuum (in the dyeing vessel) and to the dynamic pressure of the flowing liquor as in the known case. In the claimed process, the pressure which is adjusted in the dyeing vessel is just defined by the temperature of the liquor, and the differential pressure is entirely given by the grade of the excess pressure added upon steam pressure in the batch vessel which is dependent on the temperature of the liquor present therein. Since according to this invention the differential pressure is acting upon the wound-up textile material as well as from the inside to the outside as from vice versa, no deformation of the wound body must be feared.

EXAMPLE 1

Wound bodies of linear texturized polyester filaments were introduced into a dyeing vessel suitable for high temperature dyeing; this vessel was deaerated with saturated steam having 2 kp/cm$^2$ and preheated with the goods. At the same time, the total quantity of bath required for the dyeing was prepared in a batch vessel; the quantity of bath amounted to 10-times the weight of the goods and contained, referred to the weight of the dry goods:

1.3% of the disperse dyestuff of the formula

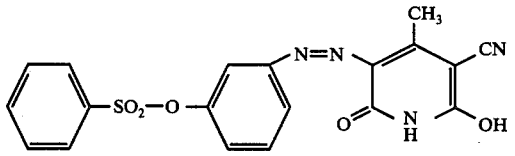

1 ccm/l of acetic acid (60% strength), 1 g/l of the sodium salt of 2,2'-dinaphthylmethane-6,6'-disulfonic acid, and 1 g/l of the reaction product of 1 mole of isotridecylalcohol and 8 moles of ethylene oxide. An air pressure of 5.5 kp/cm$^2$ was then adjusted above the level of the bath.

The bath under pressure was then heated to 140° C. By opening a blocking valve in a suitable distributor line, the heated bath was allowed to enter into the dyeing vessel within 7 to 10 seconds. This secured penetration of the dyestuff into the wound bodies from the inside as well as from the outside. After the beginning of the circulation of the bath, a mixed temperature of about 130° C adjusted. With alternating circulation of the bath, the bath temperature was raised to 135° C and the goods were dyed for 20 minutes at this temperature. The dyed material was then treated reductively and dried in the usual manner.

A level yellow dyeing was obtained.

When using in the above Example instead of the mentioned disperse dyestuff the disperse dyestuff of the formula

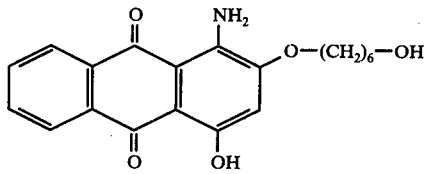

a level red dyeing was obtained.

EXAMPLE 2

Wound bodies of linear texturized polyester filaments were introduced into a dyeing vessel suitable for high temperature dyeing. In this vessel, the goods were first rinsed at 60° C with water and the rinsing bath was discharged. For dyeing the fibrous material, the process was carried out as described in Example 1, but the dyeing operation was effected using 0.7% of the weight of the goods of a disperse dyestuff of equal parts of compounds of the formulae

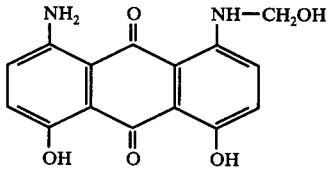

and

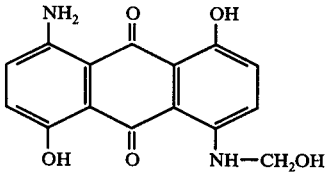

A level blue dyeing was obtained.

EXAMPLE 3

Knit goods of texturized polyester filaments were wound up on a dye beam and placed into a dyeing vessel according to Example 1. After having closed the vessel, the goods were treated for 10 minutes at 60° C with an aqueous bath which contained 2% of the weight of the goods of a mixture of auxiliary agents of 85% by weight of perchloroethylene, 7.5% by weight of the reaction product of 1 mole of castor oil and 36 moles of ethylene oxide, and 7.5% by weight of the calcium salt of tetrapropylenebenzenesulfonic acid.

This washing bath was then transferred by means of compressed air into the batch vessel and combined with 0.95% of the weight of the goods of the disperse dyestuff of the formula

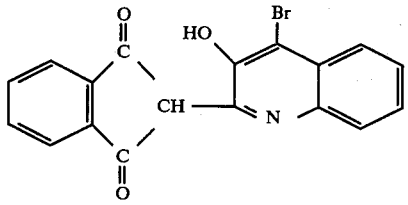

0.4% of the weight of the goods of the disperse dyestuff of the formula

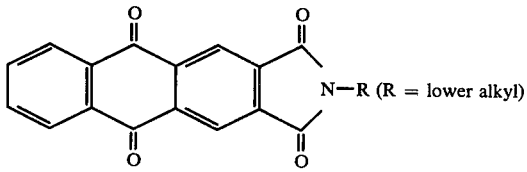

and 1 g/l of the sodium salt of 2,2'-dinaphthylmethane-6,6'-disulfonic acid and acetic acid for adjusting the pH-value to 4.5. Over the batch bath, a pressure of 6 kp/cm$^2$ was produced with compressed air and the bath so prepared was heated to 140° C.

The further treatment for dyeing the goods was carried out as described in Example 1, but with a dyeing time of 30 minutes at 130° C.

A level green dyeing was obtained.

EXAMPLE 4

A woven fabric of fibers of linear polyester, the warp consisting of normal threads and the weft of texturized threads, was wound up on a dye beam and placed into a dyeing vessel according to Example 1. After having closed the vessel, the air was eliminated from the vessel by blowing-in saturated steam at the bottom of the vessel and thus evacuating the air through the overflow line of the open circulation. As soon as steam was leaving, the overflow line was closed. Blowing-in of steam was continued until an internal pressure of 1 kp/cm$^2$ was reached. This steam pressure was maintained for 5 minutes. By this treatment the textile material was deaerated and the apparatus was preheated.

The dyeing operation was then carried out as described in Example 1.

EXAMPLE 5

The dyeing vessel and the textile material were heated as described in Example 4, but with superheated steam of 130° C for 10 minutes. The dyeing was carried out as described in Example 4.

EXAMPLE 6

Wound bodies of yarn of linear polyester fibers and staple fibers in a mixing ratio of 67 : 33 were treated as described in Example 1 and dyed.

A yellow dyeing of the polyester portion of the goods was obtained. Dyeing of the cellulose fiber portion can be effected with suitable dyestuffs, for example direct, reactive, leucovat ester dyestuffs or other dyestuffs by one-bath or two-bath processes.

EXAMPLE 7

Looped fabrics of texturized linear polyester filaments were pretreated as described in Example 4. After preheating, the goods were dyed as described in Example 1, but using 2.5% of the weight of the goods of a disperse dyestuff constituting a mixture of differently brominated diamino-dihydroxyanthraquinone having less than 1 bromine per molecule of dyestuff.

A level blue dyeing was obtained.

EXAMPLE 8

Wound bodies of texturized linear polyester filaments were introduced into a dyeing vessel suitable for high temperature dyeing; this vessel was then deaerated with saturated steam of 1.4 kp/cm$^2$ and preheated with the goods. At the same time, the total quantity of bath required for the dyeing was prepared in a batch vessel; this quantity of bath amounted to 10 times the weight of the goods and contained, referred to the weight of the dry goods, 0.25% of the disperse dyestuff of the formula

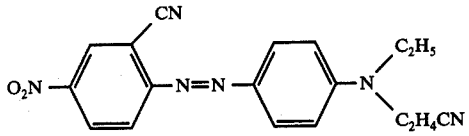

1 cmm/l of acetic acid (60% strength), 1 g/l of a dispersing agent on the basis of the condensation product of naphthalenesulfonic acid and formaldehyde, An air pressure of 5.5 kp/cm$^2$ was adjusted above the bath level.

The bath under pressure was then heated to 135° C. After having released the saturated steam pressure from the dyeing vessel, the heated bath was allowed to enter from the batch vessel which is under pressure within 7 - 10 seconds into the dyeing vessel by opening a locking valve in a suitable distributor line. This should permit penetration of the dyestuff preparation into the wound bodies from the inside and from the outside. A mixed temperature of about 125° C was adjusting. During alternating circulation of the bath the temperature of the bath was raised to 135° C. The dyed material was then after-treated reductively and dried.

A level red dyeing was obtained.

EXAMPLE 9

The dyeing operation described in Example 1 was effected using 1%, referred to the weight of the dry goods, of the disperse dyestuff 2,6-dicyano-4-nitro-2-acetylamino-4-diethylamino-azobenzene (German Patent Specification 1,290,915), instead of the disperse dyestuff mentioned in said Example, with a dyeing time of 50 minutes.

The bath batch was heated in the pressure batch vessel during the running previous dyeing. The time required for the dyeing operation itself comprised in timely order the following treatments steps programmed successively:

| | | |
|---|---|---|
| 1. Filling of the dyeing vessel with the batch bath, start of the bath circulation and formation of the required static pressure | 0.5 | min. |
| 2. Heating of the bath from 125° to 135° C | 10 | min. |

-continued

| | | |
|---|---|---|
| 3. Dyeing at 135° C | 20 | min. |
| 4. Discharging of the dyebath | 2 | min. |
| 5. Filling of the dyeing vessel with the after-treatment bath prepared in the batch vessel | 0.5 | min. |
| 6. Reductive aftertreatment | 5 | min. |
| 7. Discharging the aftertreatment bath and rinsing by continuous introduction and discharge of water | 7 | min. |
| 8. Treatment with antistatic auxiliary agents | 5 | min. |
| | 50 | min. |

Control of the different functions and of the temperature was effected with the aid of the programming devices, controlling and supervising elements developed by the measuring and control technique for pack dyeing.

EXAMPLE 10

Wound bodies of linear, texturized, acid modified polyester filaments were introduced into a dyeing vessel suitable for high temperature dyeing; this vessel was then deaerated with saturated steam of 1.2 kp/cm$^2$ and preheated with the goods for 10 min. At the same time, the total quantity of bath required for the dyeing was prepared in a batch vessel; the quantity of the bath was 10 times the weight of the goods and contained, referred to the weight of the dry goods, 0.5% of the disperse dyestuff of the formula

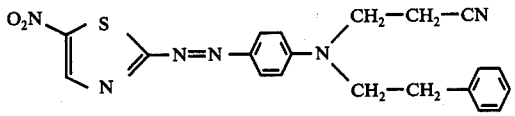

0.1 ccm/l of acetic acid (60% strength), 3 g/l of Glauber's salt.

An air pressure of 5.5 kp/cm$^2$ was adjusted above the level of the bath.

The bath under pressure was then heated to 110° C. After release of the saturated steam pressure from the dyeing vessel, the heated bath from the batch vessel under pressure was allowed to enter within 7 to 10 seconds into the dyeing vessel by opening a locking valve in a suitable distributor line. This secured penetration of the dyestuff preparation into the wound bobbin from the inside and from the outside. A mixed temperature of about 105° C adjusted. During the alternative circulation of the bath, the temperature of the bath was raised to 110° C and the goods were dyed for 20 minutes at this temperature. Then, 1 g/l of a dyeing accelerator on the basis of emulsified chlorobenzenes was added to the dyebath over the open circulation and dyeing was continued for 20 minutes. The reductive aftertreatment and drying was carried out in the manner usual for the total textile material.

A level violet dyeing was obtained.

EXAMPLE 11

Wound bodies of linear texturized polyester filaments were introduced into the dyeing vessel suitable for high temperature dyeing; this vessel was deaerated with saturated steam having 2 kp/cm$^2$ and preheated with the goods. At the same time the total quantity of bath required for the dyeing was prepared in a batch vessel; the quantity of bath amounted to 10 times the weight of the goods and contained, referred to the weight of the dry goods, a mixture dispersed in water of the components 3.6% of Disperse Black 1, C.I. No. 11365,
2.1% of Azoic Coupling Comp. 20, C.I. No. 37530,
1 g/l of a condensation product of cresol and formaldehyde and
1 g/l of a slightly adjusted buffer on the basis of polymer phosphates and a 60% acetic acid (to pH 6).

An air pressure of 5.5 kg/cm$^2$ was then adjusted above the level of the bath.

The bath under pressure was then heated to 135° C. By opening a locking valve in a suitable distributor line, the heated bath was allowed to enter into the wound bodies from the inside as well as from the outside within 7 to 10 seconds. After the beginning of the circulation of the bath a mixed temperature of about 125° C adjusted. With alternating circulation of the bath, the bath temperature was raised to 135° C and the goods were dyed for 20 minutes at this temperature. Then the dyeing apparatus was emptied by means of high temperature (HT) discharge.

In the meantime an aqueous bath was prepared in the pressure vessel with 2 cm$^3$/l of sodium hydroxide solution 38° Be (32.5%),
0.5 g/l of the reaction product of 1 mol of nonyl phenol with 10 moles of ethylene oxide and heated to 90° C. The bath was introduced into the dyeing vessel from the inside as well as from the outside by applying pressure with compressed air. A mixed temperature of about 100° C adjusted. With alternating circulation of the bath and a temperature of 100° C the goods were treated for 10 minutes. By continuous overflow rinsing the temperature was reduced to 60° C and then the treating bath was allowed to flow off. Then the material was steamed for 5 minutes at a pressure of the saturated steam of 1.5 kg/cm$^2$. In the meantime an aqueous bath was prepared in the pressure vessel with 6 cm$^3$ of acetic acid (60%) as well as
4 g/l of sodium nitrate at 110° C and after superposing compressed air, introduced into the dyeing vessel under the known conditions. A mixed temperature of 110° C was adjusted and the material was treated for 15 minutes at 110° C with alternating circulation of the bath. After completing as usual a level and very fast black dyeing was obtained.

EXAMPLE 12

Wound bodies of polyester filaments and cotton in a mixture ratio of 65:35 were introduced into a dyeing vessel according to Example 11 and previously steamed. The further treatment to dye the material was effected, as described in Example 11, but with a mixture dispersed in water of the components (from the weight of the material)

2.35% of Disperse Black 1, C.I. No. 11365 and
1.4% of Azoic Coupling Comp. 20, C.I. No. 37530, until the intermediate purification was finished. By continuous overflow rinsing the bath temperature was reduced to 30° C and the bath was subsequently allowed to discharge.

The subsequent cross-dyeing of the cotton portion was effected with an aqueous bath containing (from the weight of the material)

0.6% of the dyestuff Sol. Vat Orange 1, C.I. No. 59106,
1 g/l of calcinated soda and
10 g/l of calcinated sodium sulfate during 20 minutes at a temperature of 30° C. Then the dyebath was discharged.

In the meantime a bath had been prepared in the pressure vessel which contained on an aqueous base 6 cm$^3$/l of acetic acid (60%) as well as
4 g/l of sodium nitrate and which, after superposing compressed air, was heated to 135° C. By opening a blocking valve in a suitable distributor line the bath was introduced into the dyeing vessel with the material from the inside as well as from the outside and after starting the pump for the circulation of the bath a mixed temperature of 85° C was adjusted. With an alternating circulation of the bath the temperature of treatment was increased to 110° C and the material was treated for 15 minutes.

After completing as usual an even dyeing was obtained, whereby the polyester fiber had a black color and the portion of cotton a yellow color.

EXAMPLE 13

Wound bodies of polyester filaments and cotton in a mixture ratio of 50:50 were introduced according to Example 11 into a dyeing vessel and previously dyed. The further treatment for dyeing the goods was effected, as described in Example 11, but with (from the weight of the material)

the dispersed mixture of dyestuff components in analogy to Example 12, until the high temperature stage was finished when dyeing the polyester portion. The dyebath was subsequently discharged under high temperature conditions (HT-outlet).

In the meantime a bath was prepared in the pressure vessel which contained in the aqueous medium 7% of the dyestuff Vat Black 9, C.I. No. 65230 and which was heated to 65° C. After introducing compressed air into the batch the bath was transferred from the inside and from the outside into the dyeing vessel containing the textile material and after starting the pump for the circulation of the bath a mixed temperature of 80° C was adjusted. With an alternating circulation of the bath
40 cm$^3$/l of sodium hydroxide solution 38° Be (32.5%) and
10 g/l of sodium dithionite (as a solution in water) were added after 20 minutes over the open circulation and the material was dyed for 30 minutes at 80° C. By cold continuous rinsing the pH-value of the textile material was adjusted to pH 8 and then the rinsing bath was allowed to discharge. The textile material was subsequently steamed for 5 minutes at 120° C.

The diazotation bath prepared in the meantime and heated to 110° C containing in water 8 cm$^3$/l of acetic acid (60%)
4 g/l of sodium nitrite, was superposed in the pressure vessel with compressed air of 5.5 kp/cm$^2$ and introduced into the dyeing vessel from the inside and from the outside by opening a distributor line. After starting the circulation of the bath a mixed temperature of 110° C adjusted and the textile material was treated for 15 minutes with alternating bath circulation.

After completing as usual an even fast black dyeing was obtained on both fiber portions.

EXAMPLE 14

Looped materials of triacetate fibers were introduced in a wound-up state into a HT beam dyeing apparatus for piece goods. This vessel was then deaerated by saturated steam of 0.4 kp/cm$^2$ and pre-heated with the material. Simultaneously, the whole amount of the bath necessary for dyeing was prepared in a batch vessel; the quantity of bath amounted to 10 times the weight of the goods and contained, referred to the weight of the dry goods, a mixture dispersed in water of the components 3.0% of Disperse Black 1, C.I. No. 11365,
1.75% of Azoic Coupling Comp. 20, C.I. No. 37530,
1 g/l of the condensation product of cresol/formaldehyde and
1 g/l of the buffer mentioned in Example 1, on the basis of polymer phosphates and 60% acetic acid (to pH 6).

A pressure of compressed air of 5.5 kp/cm$^2$ was adjusted.

The bath preparation under pressure was heated to 110° C. By opening a locking valve in a suitable distributor line the heated bath was allowed to enter within 7 to 10 seconds into the wound bodies from the inside as well as from the outside. After beginning the bath circulation a mixed temperature of 110° C was adjusted. With alternating bath circulation the material was treated for 30 minutes. Then the dyeing liquor was cooled to 85° C. The material was then rinsed continuously at 60° C during 10 minutes.

For an intermediat purification 2 cm$^3$/l of sodium hydroxide solution 38° Be (32.5%) and
0.5 g/l of the reaction product of one mol of nonyl phenol and 10 mols of ethylene oxide were added to this aqueous bath over the open circulation and the textile material was treated for 10 minutes at 70° C. It was followed by a rinsing process at 60° C. Then the material was diazotized during 15 minutes at 60° C with an aqueous bath containing 2.5 cm$^3$/l of sulfuric acid (96%) and
2 g/l of sodium nitrite.

The additives were introduced over the open circulation. After cooling as usual an even black dyeing was obtained.

EXAMPLE 15

Wound bodies of linear texturized polyester filaments were introduced according to Example 11 into a dyeing vessel and previously steamed. The further treatment for dyeing the textile material was effected, as described in Example 11, but with a mixture dispersed in water of the components:

3.0% of Solvent Brown 3, C.I. No. 11360
1.75% of Azoic Coupling Comp. 20, C.I. No. 37530
1 cm$^3$/l of sodium hydroxide solution 38° Be (32.5%)
1 g/l of the condensation product of cresol/formaldehyde and
2 g/l of sodium monochloracetate.

After impregnation the material was subjected to intermediated purification and diazotation as described in Example 11.

An even black dyeing was obtained.

EXAMPLE 16

Wound bodies of polyester fibers and cotton in a mixture ratio of 65:35 were introduced according to Example 11 into a dyeing vessel and previously steamed. The further treatment for dyeing the textile material was effected, as described in Example 11, but with a mixture dispersed in water of the components (from the weight of the material)

2.1% of Disperse Black 1, C.I. No. 11365 and
1.2% of Azoic Coupling Comp. 20, C.I. No. 37530,
until the HT-stage was completed when dyeing the polyester portion. The dyebath was discharged under high-temperature conditions (HT-outlet).

In the meantime a bath was prepared in the pressure vessel which contained on an aqueous base 6% of a dyestuff Sol. Sulphur Black, C.I. No. 53186 and
5 g/l of calcinated sodium carbonate.

After pressing compressed air onto the bath preparation and heating to 115° C, the bath was transferred from the inside and the outside into the dyeing vessel containing the textile material. After starting the circulation of the bath a mixed temperature of 110° C was adjusted. With alternating bath circulation 12 cm$^3$/l of sodium hydrogen sulfide solution (21%) and
3 cm$^3$/l of ammonium polysulfide solution (15%) were added after 10 minutes over the open circulation, then, in the same way
20 g/l of sodium sulfate were added.

With alternating bath circulation the material was dyed for 30 minutes at 95° C. Then the material was rinsed continuously for 10 minutes. After discharging the rinsing bath the dyestuff was oxidized during 10 minutes at 40° C with an aqueous bath containing 1 cm$^3$/l of hydrogen peroxide (35%), the oxydation bath was discharged, the dyeing was rinsed for a short time and the textile material was steamed for 5 minutes at 120° C.

The diazotation bath prepared in the meantime in the pressure vessel and heated to 110° C, containing on an aqueous base 8 cm$^3$/l of acetic acid (60%) and
4 g/l of sodium nitrite was superposed with compressed air of 5.5 kp/cm$^2$, and by opening a distributor line, introduced into the dyeing vessel from the inside as well as from the outside. After starting the bath circulation a mixed temperature of 110° C appeared and the textile material was treated for 15 minutes with alternating bath circulation.

After completing as usual a even black dyeing was obtained on both fiber portions.

EXAMPLE 17

Wound bodies of polyacrylonitrile fibers were introduced into a dyeing vessel suitable for high temperature dyeings. This vessel was de-aerated with saturated steam of 1.2 kp/cm$^2$ and the goods were so preheated. At the same time, the total quantity of aqueous bath required for the dyeing was prepared in a pressure-tight batch vessel; the quantity of bath amounted to 10 times the weight of the goods and contained 0.5% of the cationic dyestuff of the formula

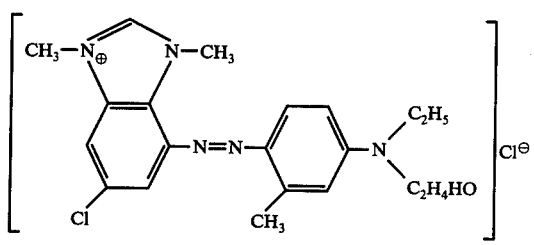

2% of sodium acetate 2.5% of a cation-active retarder on the basis of coconut fat alkyl-dimethyl-benzyl-ammonium chloride and 1 ccm/l of acetic acid (60% strength).

An air pressure of 5.5 kp/cm$^2$ was then adjusted above the level of the bath.

The bath under pressure was then heated to 105° C. By opening a blocking valve in a suitable distributor line, the heated bath was allowed to enter into the dyeing vessel within 7 to 10 seconds. This secured penetration of the dyebath into the wound bodies from the inside as well as from the outside. After the beginning of the circulation of the bath, a mixed temperature of 102° C adjusted. With alternating circulation of the bath, the bath temperature was raised to 105° C and the goods were dyed for 30 minutes at this temperature. The dyed material was rinsed hot and cold with water and dried. A level red dyeing was obtained.

When using in the above example instead of the mentioned cationic dyestuff the product Basic Blue 3 (C.I. No. 51004), a level blue dyeing was obtained.

EXAMPLE 18

Wound bodies of polyacrylonitrile fibers were introduced in a dyeing vessel suitable for high temperature dyeing. After having closed the vessel, the goods were preheated with saturated steam to 100° C and then treated for 10 minutes at 90° C with an aqueous bath which contained, referred to the weight of the goods, 2.4% of a cation-active retarder on the basis of coconut fat alkyl-dimethyl-benzyl-ammonium chloride, 2% of sodium acetate and 1 ccm/l of acetic acid (60% strength).

This bath was then pressed by means of compressed air into the batch vessel and combined with 0.9% (referred to the weight of the dry goods) of the cationic dyestuff Basic Red 9 (C.I. No. 42520) and, if necessary, with acetic acid to correct the pH value to 5. A pressure of 6 kp/cm$^2$ adjusted over the bath with compressed air and the bath so prepared was heated to 150° C.

The further treatment for dyeing the goods was effected as described in Example 17, but eith a dyeing time of 20 minutes and 105° C.

A level red dyeing was obtained.

EXAMPLE 19

Yarn wound bodies of polyacrylonitrile fibers and staple fibers in a mixing ratio of 60:40 were dyed according to the method described in Example 17.

A level red dyeing of the polyacrylonitrile portion was obtained. The cellulose fiber portion could be dyed using suitable dyestuffs, for example direct, reactive, leucovat ester dyestuffs or other dyestuffs, by the one-bath or two-bath method.

EXAMPLE 20

Yarn wound bodies of polyacrylonitrile fibers and wool in a mixing proportion of 55:45 were dyed according to the method described in Example 17 with an aqueous bath which contained, referred to the weight of the goods, 1.5% of the cationic dyestuff of the formula

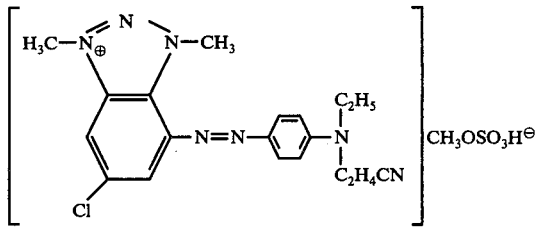

2% of sodium acetate and 1 ccm/l of acetic acid (60% strength).

A level bordo dyeing of the polyacrylonitrile portion was obtained.

The wool fiber portion could be dyed using suitable dyestuffs, for example acid, metal complex and reactive dyestuffs, according to the one-bath or two-bath method.

EXAMPLE 21

Wound bodies of acid modified texturized polyester fiber were introduced into a dyeing vessel suitable for high temperature dyeing. This vessel was then deaerated with saturated steam of 1.25 kp/cm$^2$ and the goods were preheated in this manner. At the same time the total quantity of aqueous dyebath required for dyeing was prepared in a pressure-tight batch vessel; this bath amounted to 10 times the weight of the goods and contained, referred to the weight of the dry goods, 0.2% of the cationic dyestuff Basic Green 4 (C.I. No. 42000), 1 g/l of a non-ionic dispersing agent on the basis of the reaction product of 1 mole of stearyl alcohol and 25 moles of ethylene oxide, containing 25% of polyethylene glycol of a molecular weight of about 6000, 3 g/l of sodium sulfate, crystallized, 2% of sodium acetate and 2% of acetic acid (60% strength).

The further treatment of the goods was effected as described in Example 17, however, the dyebath was shot in at 110° and the goods were dyed for 30 minutes at this temperature.

The aftertreatment of the dyeing was effected by hot intermediate rinsing with water at 90° C and then with an aqueous bath which contained 3 g/l of sodium carbonate, anhydrous, 3 g/l of sodium dithionite and 3 g/l of sodium sulfate, crystallized, for 10 minutes at 85° C. Finally, the goods were again rinsed hot and cold with water and dried.

A level green dyeing was obtained.

EXAMPLE 22

Knit goods of polyacrylonitrile fibers were wound on a dyeing beam, introduced into a dyeing vessel as that described in Example 17 and treated as described in the said Example 17.

A level red dyeing was obtained.

EXAMPLE 23

Wound bodies of crimp nylon were introduced into a dyeing vessel suitable for high temperature dyeing. This vessel was then deaerated with saturated steam of 1.5 kp/cm$^2$ and the goods were thus preheated.

At the same time, the total quantity of aqueous bath required for dyeing was prepared in a pressure-tight batch vessel; the quantity of bath amounted to 10 times the weight of the goods and contained, referred to the weight of the dry goods, 0.6% of the anionic dyestuff Acid Blue 41 (C.I. No. 62130), 2.5% of the reaction product of 1 mole of cyanuric chloride and 3 moles of metanilic acid, 0.5% of a mixture of 75% of the reaction product of 1 mole of stearylamine and 10 moles of ethylene oxide, and 25% of dodecylsulfonic acid, and 0.8% of acetic acid (60% strength).

A pressure of 5.5 kp/cm$^2$ was produced with compressed air over the bath in the batch vessel.

The bath under pressure was then heated to 115° C. The bath was transferred by pressure into the dyeing vessel as described in Example 17, at the beginning of the circulation of the bath, a mixed temperature of 110° C adjusted. The bath temperature was raised to 115° C and the material was further treated as described in Example 17, but with a dyeing time of 15 minutes only.

A level blue dyeing was obtained on the polyamide wound bodies.

EXAMPLE 24

Wound bodies of wool fibers were introduced into a dyeing vessel suitable for high temperature dyeings and dyeings at boiling temperature. This vessel was deaerated with saturated steam of 1.2 kp/cm$^2$ and the goods were in this manner preheated.

At the same time, the total quantity of aqueous liquor required for the dyeing, was prepared in a pressure-tight batch vessel; the quantity of bath amounted to 10 times the weight of the goods and contained, referred to the weight of the dry goods, 0.7% of the anionic dyestuff Acid Blue 41 (C.I. No. 62130)

(a) 20% of sodium sulfate, crystallized, and 3% of sulfuric acid (96% strength) or (b) 20% of sodium sulfate, crystallized, and 1.5% of formic acid (85% strength).

An air pressure of 5.5 kp/cm$^2$ was then adjusted above the level of the bath.

The bath under pressure was then heated to 105° C. By opening of a blocking valve in a suitable distributor pipe, the heated bath was allowed to enter within 7 to 10 seconds into the dyeing vessel. This secured penetration of the dyebath into the wound bodies from the inside as well as from the outside. After the beginning of the circulation of the bath, a mixed temperature of 100° C adjusted. The goods were then dyed for 20 minutes at the temperature mentioned with alternating circulation of the bath. The dyed material was then rinsed with water and dried in the usual manner.

A level blue dyeing was obtained.

When using in the above Example instead of the blue dyestuff.

0.9% of the anionic dyestuff Acid Green 44 (C.I. No. 61590),

20% of sodium sulfate, crystallized and 0.5% of acetic acid (60% strength) or

8% of ammonium acetate, a level green dyeing was obtained.

EXAMPLE 25

Wound bodies of wool fibers were introduced in the manner described in Example 24, into a dyeing vessel which was suitable for HT-dyeing or dyeing at boiling temperature. The preparation of the bath was effected in the same manner as described in Example 24, but using 2% of the anionic dyestuff of the formula

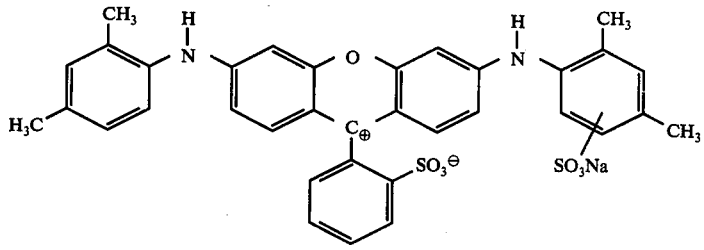

1.5% of the reaction product of 1 mole of stearyl amine and 12 moles of ethylene oxide, 20% of sodium sulfate, crystallized, and 2% of acetic acid (60% strength).

Dyeing was then carried out as described in Example 24, but with a dyeing time of 30 minutes.

After the usual completion, a level violet dyeing was obtained.

EXAMPLE 26

Wound bodies of wool fibers were introduced in the manner described in Example 24 into a dyeing vessel which was suitable for HT-dyeing or dyeing at boiling temperature. The dyebath was prepared in the manner described in Example 24, but using 1.2% of the 1:2-chromium complex compound of the anionic dyestuff of the formula

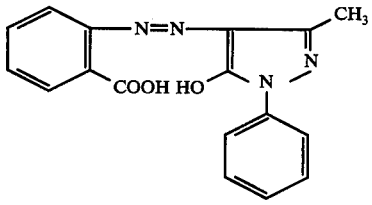

0.6% of a mixture of equal parts of the reaction product of 1 mole of 2-heptadecyl-4-ethyl-4-hydroxymethyloxazoline and 90 moles of ethylene oxide, and of the reaction product of 1 mole of 2-amino-2-ethyl-propane-diol-1,3-stearic acid ester and 90 moles of ethylene-oxide, 5% of ammonium sulfate or ammonium acetate and 1% of acetic acid (60% strength). Dyeing was carried out as described in Example 24, but with a dyeing time of 30 minutes.

After the usual further treatment, a level yellow dyeing was obtained.

EXAMPLE 27

Wound bodies of wool fibers were introduced in the manner described in Example 24 into a dyeing vessel which was suitable for HT-dyeing and dyeing at elevated temperature. The dyebath was prepared in the manner described in Example 24, but using 2% of the anionic reactive dyestuff of the formula

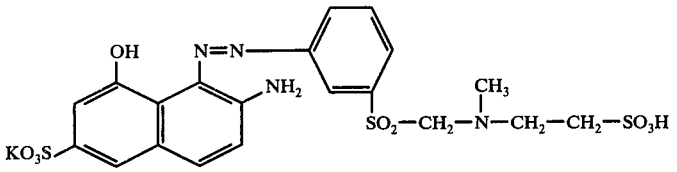

1.5% of the reaction product of 1 mole of stearyl amine and 12 moles of ethylene oxide, 4% of acetic acid (60% strength) and 3% of ammonium sulfate.

A pressure of 5.5 kp/cm$^2$ was then produced with compressed air above the dyeing liquor.

The bath under pressure was heated to 105° C. By opening a locking valve in a suitable distributor pipe, the heated liquor was allowed to enter into the dyeing vessel within 7 to 10 seconds. This secured penetration of the dyeing liquor into the wound bodies from the inside and from the outside. After beginning of the circulation of the bath, a mixed temperature of 100° C adjusted. The goods were then dyed for 40 minutes at the mentioned temperature with alternating circulation of the bath. Then, 5% of sodium trichloroacetate were added to the dyebath and the goods were further treated for 20 minutes at 100° C. The dyed material was then rinsed warm and cold with water. A level red dyeing was obtained.

EXAMPLE 28

Wound bodies of mixtures of polyester and wool fibers (mixing ratio 55:45) were introduced into a dyeing vessel which was suitable for HT-dyeing. This dyeing vessel was then deaerated with saturated steam of 1.2 kp/cm$^2$, whereby the goods were preheated.

At the same time, the total quantity of aqueous bath, required for the dyeing, was prepared in a pressure-tight batch vessel; the quantity of the bath amounted to 10 times the weight of the goods and contained, referred to the weight of the dry goods, 1.96% of the disperse dyestuff of the formula

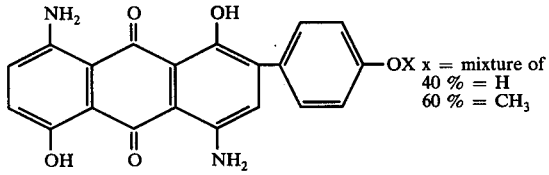

0.72% of a disperse dyestuff consisting of about equal parts of compounds of the formulae

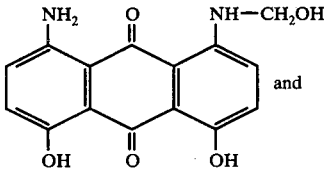

and

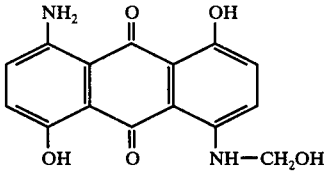

1.36% of the anionic dyestuff of the formula

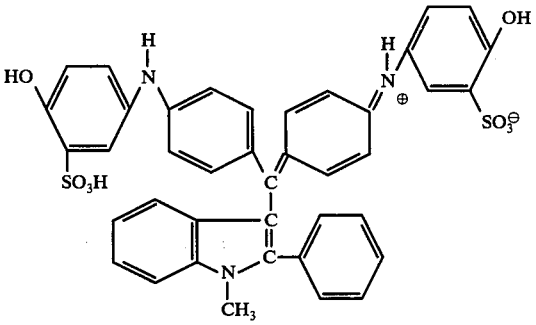

4.5 g/l of emulsified carrier on the basis of methylnaphthalene, 0.3% of a mixture of equal parts of the reaction product of 1 mole of 2-heptadecyl-4-ethyl-4-hydroxymethyloxazoline and 90 moles of ethylene oxide, and of the reaction product of 1 mole of 2-amino-2-ethylpropanediol-1,3-stearic acid ester and 90 moles of ethylene oxide, 4% of ammonium sulfate or ammonium acetate, and 1% of acetic acid (60% strength).

A pressure of 5.5 kp/cm$^2$ was produced above the bath with compressed air.

The bath under pressure was then heated to 110° C. By opening a locking valve in a suitable distributor line, the heated liquor was allowed to enter into the dyeing vessel within 7 to 10 seconds. This secured penetration of the dyeing liquor into the wound bodies from the inside and from the outside. After beginning of the circulation of the bath, a mixed temperature of 104° C adjusted. The goods were then dyed for 30 minutes at the mentioned temperature. After dyeing, the dyed material was rinsed with water and the dyeing was aftertreated for 10 minutes at 75° C with an aqueous bath containing 2 g/l of an emulsifier on the basis of a mixture of 40% of the reaction product of 1 mole of sesame oil and 36 moles of ethylene oxide,
42% of phenyl-kogasin-sulfonate (Ca-salt) and
18% of isopropanol, and
0.5 ccm/l of acetic acid (60% strength).

A level blue dyeing was obtained.

EXAMPLE 29

Wound bodies of mixtures of polyacrylonitrile and wool fibers (mixing ratio 50:50) were introduced into a dyeing vessel suitable for HT-dyeing and dyeing at boiling temperature. This vessel was deaerated with saturated steam of 1.2 kp/cm$^2$, whereby the goods were preheated.

At the same time, the total quantity of aqueous bath, required for the dyeing, was prepared in a pressure-tight batch vessel; the quantity of bath amounted to 10 times the weight of the goods and contained, referred, to the weight of the dry goods, 0.5% of the cationic dyestuff of the formula

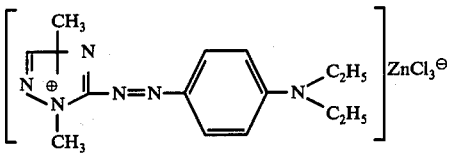

0.75% of the anionic reactive dyestuff of the formula

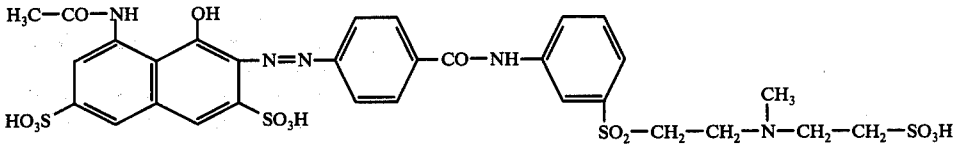

1% of the reaction product of 1 mole of stearyl amine and 12 moles of ethylene oxide,
1% of the reaction product of 1 mole of stearyl alcohol and 25 moles of ethylene oxide, containing 20% of polyethylene glycol of a molecular weight of ~6000,
X ccm/l of acetic acid (60% strength) for adjusting the pH-value of the bath to about 5.

A pressure of 5.5 kp/cm$^2$ was produced above the level of the bath with compressed air.

The bath under pressure was then heated to 108° C. By opening a locking valve in a suitable distributor line, the heated liquor was allowed to enter into the dyeing vessel within 7 to 10 seconds. This secured penetration of the dyeing liquor into the wound bodies from the inside and from the outside. After beginning of the circulation of the bath, a mixed temperature of 103° C adjusted. The goods were then treated for 30 minutes at 103° C with alternating circulation of the dyeing liquor. After cooling of the bath to 80° C, 3% of ammonia (25% strength) were added and the goods were subjected to a further treatment for 10 minutes at 80° C. The dyed material was then rinsed warm and cold with water.

A level red dyeing was obtained.

EXAMPLE 30

Wound bodies of cellulose fibers were introduced into a dyeing vessel suitable for high temperature dyeings and for dyeing at boiling temperature. This vessel was deaerated with saturated steam of 1.2 kp/cm$^2$ and the goods were so preheated. At the same time, the total quantity of aqueous bath required for the dyeing was prepared in a pressure-tight batch vessel; the quantity of bath amounted to 10 times the weight of the goods and contained 1% of the vat dyestuff Vat Orange 7 (C.I. No. 71105),
33 ccm/l of sodium hydroxide solution of 38° Be (32.5%),
3 g/l of sodium dithionite and
1 g/l of an auxiliary levelling agent on the basis of quaternary ammonium compounds. An air pressure of 5.5 kp/cm$^2$ was then adjusted above the level of the bath.

The bath under pressure was then heated to 100° C. By opening a blocking valve in a suitable distributor line, the heated bath was allowed to enter into the dyeing vessel within 7 to 10 seconds. This secured penetration of the dyebath into the wound bodies from the inside as well as from the outside. After the beginning of the circulation of the bath, a mixed temperature of 90° C adjusted. With alternating circulation of the bath, the goods were cooled to 60° C within 10 min. and then dyed for 20 min. at 60° C. Then, the dyed material was rinsed as usual with water, oxidized and soaped.

A level orange dyeing was obtained.

EXAMPLE 31

Wound bodies of cellulose fibers were introduced into a dyeing vessel as described in Example 30, which was suited for high temperature dyeing and dyeing at boiling temperature. The batch was prepared in the same manner, but using 6% of the water-soluble sulfur dyestuff Solubilised Sulphur Green 9 (C.I. No. 53006),
1 g/l of an anion-active wetting agent on the basis of an alkane-sulfonate,
5 g/l of sodium carbonate, calcinated, and
20 g/l of sodium sulfate, calcinated. A pressure of 5.5 kp/cm$^2$ was produced with compressed air above level of the bath.

The bath under pressure was then heated to 100° C. By opening a blocking valve in a suitable distributor line, the heated liquor was allowed to enter within 7 to 10 seconds from the inside and from the outside into the dyeing vessel. After the beginning of the circulation of the batch, a mixed temperature of 90° C adjusted. The goods were treated for 5 minutes at this temperature with alternating circulation of the bath. Then, 12 ccm/l of an aqueous solution of sodium hydrogeno-sulfide (21% strength), were added to the dyebath and the goods were further treated for 30 minutes at 90° C. The dyed material was then rinsed with water oxidized and rinsed again as usual.

A level olive dyeing was obtained.

EXAMPLE 32

Wound bodies of cellulose fibers were introduced into a dyeing vessel as described in Example 30, which was suited for high temperature dyeing and dyeing at boiling temperature. The dyeing liquor was prepared in the same manner as described in Example 30, but using 1% of the reactive dyestuff of the formula

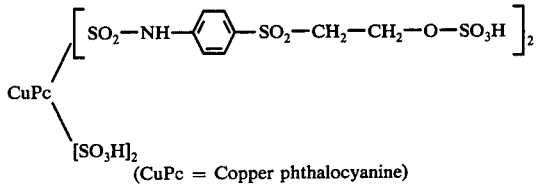

(CuPc = Copper phthalocyanine)

1 g/l of an anion-active wetting agent according to German Pat. Specification No. 1,245,898, 50 g/l of sodium sulfate, calcinated. The dyeing liquor under pressure (5.5 kp/cm²) was heated to 100° C. By opening a blocking valve in a suitable distributor line, the heated liquor was allowed to enter within 7 to 10 seconds into the dyeing vessel, the penetration of the dyestuff liquor into the wound bodies taking place from the inside and from the outside. After the beginning of the circulation of the bath, a mixed temperature of 90° C adjusted. The goods were then treated for 5 minutes at this temperature with alternating circulation of the bath. Then, 10 g/l of sodium carbonate, calcinated, were added to the dyebath and the goods were further treated for 20 minutes at 90° C. The dyed material was then rinsed with water, soaped and rinsed again as usual.

A level turquoise dyeing was obtained.

When using in the above Example instead of the above-mentioned turquoise dyestuff 1 g/l of the reactive dyestuff of the formula

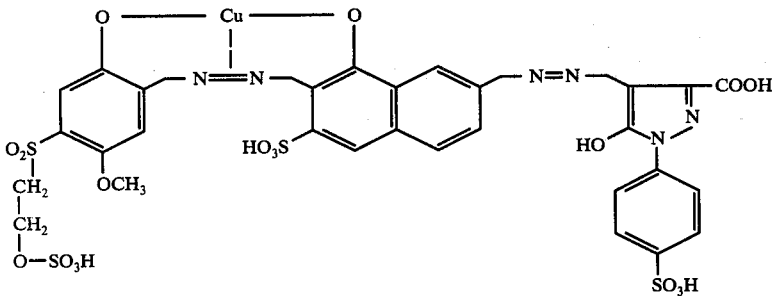

and cooling the bath with the goods after transfer of the dyeing liquor from the batch vessel under pressure into the dyeing vessel from 90° C to 60° C, before adding 2 ccm/l of sodium hydroxide solution, there were obtained on cellulosic fibers after a dyeing time of 20 minutes at 60° C and the usual after treatment a level grey dyeing.

When using instead of the above mentioned dyestuff the reactive dyestuff of the formula

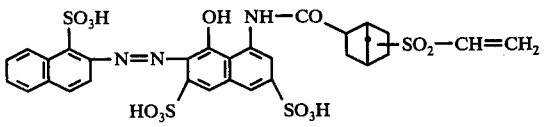

a level red dyeing was obtained.

EXAMPLE 33

Wound bodies of mixtures of polyester and cellulose fibers (mixing ratio 67:33) were introduced into a dyeing vessel suitable for high temperature dyeing and dyeing at boiling temperature. This vessel was deaerated with saturated steam of 1.2 kp/cm² and the goods were preheated in this manner.

At the same time, the total quantity of dyeing liquor required for the dyeing was prepared in a pressure-tight batch vessel; the quantity of bath amounted to 10 times the weight of the goods and contained, referred to the weight of the dry goods, 1% of the disperse dyestuff of the formula

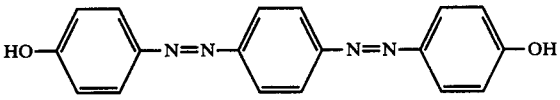

1.7% of the disperse dyestuff of the formula

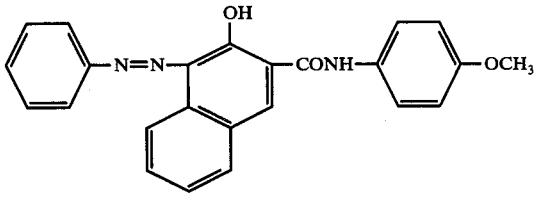

2.3% of the vat dyestuff Vat Orange 7 (C.I. No. 71105), 1 g/l of a condensation product of formaldehyde and naphthalene-sulfonic aicd and X ccm/l of acetic acid (60% strength) for adjusting the pH-value of the dyeing liquor to about 4.5.

A pressure of 5.5 kp/cm² was adjusted above the level of the dyeing liquor with compressed air.

The dyeing liquor under pressure was heated to 135° C. By opening a locking valve in a suitable distributor line, the heated bath was allowed to enter into the dyeing vessel within 7 to 10 seconds, the dyeing liquor penetrating into the wound bodies from the inside and from the outside. After beginning of the circulation of the bath, a mixed temperature of 125° C adjusted. The goods were heated to 135° C with alternating circulation of the bath and dyed for 20 minutes at this temperature. The goods were then cooled to 60° C and, after addition of 20 ccm/l of a sodium hydroxide solution of 38° Be (32.5% strength), 7 g/l of sodium dithionite and 10 g/l of sodium sulfate, calcinated, to the dyebath, treated for 30 minutes at 60° C.

After the usual aftertreatment such as rinsing, oxidation and soaping, a level orange dyeing was obtained on both fiber components.

EXAMPLE 34

Wound bodies of polyester and cellulose fibers at a mixing ratio of 70:30 were introduced into a dyeing vessel as described in Example 30, the dyeing vessel being suitable for hightemperature dyeing and dyeing at boiling temperature. This vessel was then de-aerated with saturated steam of 1.2 kp/cm² and preheated together with the material to be dyed.

The total quantity of bath necessary for the dyeing operation was then prepared in a batch vessel; the quantity of bath amounted to 10 times the weight of the goods and contained, as referred to the weight of the dry material, 1.4% of the disperse dyestuff of the formula

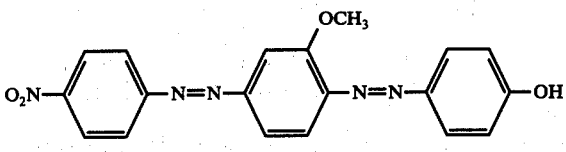

1.5% of the reactive dyestuff of the formula

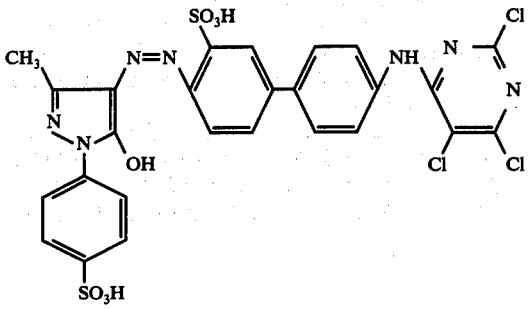

1 g/l of condensed sodium polyphosphate 1 g/l of a condensation product of formaldehyde and creosol 50 g/l of sodium sulfate, cristallized. A pressure of 5.5 kp/cm² was adjusted over the level of the bath with compressed air.

The bath under pressure was heated to 135° C. By opening a blocking valve in a suitable distributor line, the heated bath was allowed to run into the dyeing vessel within 7 to 10 seconds, whereby the penetration of the wound bodies was effected from inside as well as from outside. After the beginning of the bath circulation, a mixed temperature of 125° C adjusted, With alternating circulation of the bath, the material was then dyed for 20 minutes at 135° C. The dyebath was then cooled to 90° C and 15 g/l of sodium carbonate, calcinated, were added. The final dyeing time of the textile goods thus amounted to 30 minutes at 90° C.

After the usual aftertreatment, a level orange dyeing was obtained on both fiber portions.

EXAMPLE 35

Wound bodies of cellulose and polyacrylonitrile fibers (at a mixing ratio of 40:60) were introduced into a dyeing vessel which was suitable for high-temperature dyeing and dyeing at boiling temperature and which contained already the total quantity of aqueous dyebath necessary for dyeing. The quantity of dyebath amounted to 10 times the weight of the goods and contained - as referred to the weight of the dry material 1% of the reactive dyestuff of the formula

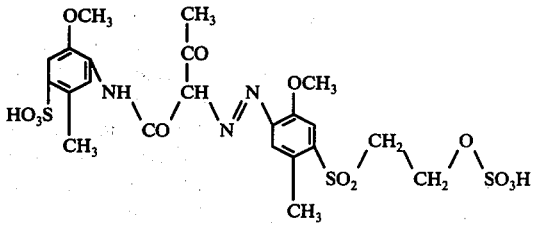

1 g/l of an anion-active wetting agent, 5 g/l of sodium carbonate, calcinated, 1 ccm/l of sodium hydroxide solution of 38° Be (32.5% strength) and 50 g/l of sodium sulfate, calcinated.

After the beginning of the alternating circulation of the bath, the temperature of the bath was raised to 60° C. The material was dyed at this temperature for 30 minutes. Then, the textile material was rinsed cold and neutralized with an aqueous bath containing 2 ccm/l of acetic acid (60% strength).

Subsequently, the dyeing vessel was de-aerated with saturated steam of 1.2 kp/cm² and the material was simultaneously preheated.

Meanwhile, the total aqueous quantity of bath necessary for the dyeing of the polyacrylonitrile fiber portion was prepared in the batch vessel with the following products:

0.5% of the cationic dyestuff of the formula

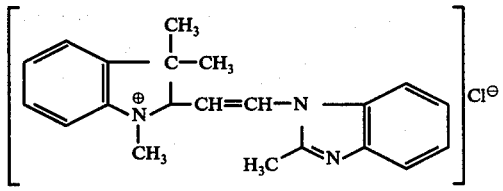

2.5% of a cationic retarder on the basis of quaternary ammonium salts,

2% of sodium acetate, crystallized, and 1 ccm/l of acetic acid (60% strength)

A pressure of 5.5 kp/cm² was adjusted over the level of the bath with compressed air.

The bath under pressure was heated to 105° C. By opening a blocking valve in a suitable distributor line, the heated bath was allowed to run into the dyeing vessel within 7 to 10 seconds, whereby the penetration of the wound bodies with the dyestuff preparation was effected from the inside as well as the outside. After the beginning of the bath circulation, a mixed temperature of 104° C adjusted. During alternating circulation of the bath, the material was dyed for 20 minutes at 105° C. After the usual after-treatment, a level yellow dyeing was obtained on both fiber components of the mixture.

We claim:

1. In a process for the dyeing of textile materials in the form of wound bodies according to the exhaust method at temperatures ranging at or above 100° C, in which process the wound bodies contained in a pressure-tight dyeing vessel are heated as well as deaerated before the actual dyeing operation and subsequently contacted with the dyeing liquor which has been separately heated to about dyeing temperature in a pressure-tight batch vessel, placed under a relative excess pressure of from 2.94 to 9.81 bars and then transferred in its total amount from said batch vessel into said dyeing vessel, and in which the dyeing operation is completed by circulation of the dyeing liquor, the improvement which comprises: exposing the wound bodies to an atmosphere of steam at about dyeing temperature prior to contact with the dyeing liquor in order to preheat and de-aerate said textile materials; and transferring the dyeing liquor by means of said relative excess pressure and towards the pressure of the air-free atmosphere of the steam into the dyeing vessel, simultaneously from both the inside and the outside of said wound bodies, thereby entirely condensing the steam in said vessel and filling it completely by the transferred liquor.

2. A process as claimed in claim 1, wherein the relative excess pressure for transferring the dyeing liquor from the batch vessel into the dyeing vessel is produced by compressed air.

3. A process as claimed in claim 1, wherein textile materials made from synthetic fibers or from mixtures which contain such fibers are dyed with water-insoluble disperse dyestuffs at temperatures in the range of from 110° to 145° C.

4. A process as claimed in claim 3, wherein polyamide or polyester fibers are used as synthetic fibers.

5. A process as claimed in claim 1, wherein textile materials made from synthetic fibers or from mixtures which contain synthetic fibers are dyed with primary components that are used for the preparation of water-insoluble developing black dyestuffs at temperatures in the range of from 105° to 135° C and said dyestuffs are developed by methods based on the diazo and oxidation dyeing technique under the above-mentioned pressure and temperature conditions using a second liquor.

6. A process as claimed in claim 5, wherein polyester or triacetate fibers are used as synthetic fibers.

7. A process as claimed in claim 1, wherein textile materials made from synthetic fibers which are dyeable with ionic dyestuffs or from mixtures which contain such synthetic fibers are dyed with water-soluble cationic or anionic dyestuffs at temperatures in the range of from 100° to 120° C.

8. A process as claimed in claim 7, wherein polyamide, polyurethane, basic modified polyester or polyolefin fibers, which can be dyed with anionic acid, chromium, metal complex and reactive dyestuffs, are used as synthetic fibers.

9. A process as claimed in claim 7, wherein polyacrylonitrile or acid modified polyester or polyolefin fibers, which can be dyed with cationic dyestuffs, are used as synthetic fibers.

10. A process as claimed in claim 1, wherein textile materials made from wool or from mixtures which contain wool are dyed with anionic dyestuffs at temperatures in the range of from 100° to 110° C.

11. A process as claimed in claim 10, wherein acid, chromium, metal complex and reactive dyestuffs are used as anionic dyestuffs.

12. A process as claimed in claim 1, wherein textile materials made from cellulosic fibers or from mixtures which contain such cellulosic fibers are dyed with soluble dyestuffs or with solubilized vat or sulfur dyestuffs at temperatures in the range of from 100° to 135° C.

13. A process as claimed in claim 12, wherein cellulose fibers and their mixtures with synthetic fibers are used as the material to be dyed.

14. A process as claimed in claim 12, wherein vat dyestuffs, sulfur vat dyestuffs, sulfur dyestuffs, soluble sulfur dyestuffs, leuco vat ester dyestuffs, reactive dyestuffs and direct dyestuffs are used as dyestuffs for the cellulose fibers.

* * * * *